US005829363A

United States Patent [19]

Reilly

[11] Patent Number: 5,829,363

[45] Date of Patent: Nov. 3, 1998

[54] COLLAPSIBLE PALLET

[76] Inventor: Robert Reilly, 985 Pine Tree La., Winnetka, Ill. 60093

[21] Appl. No.: 895,528

[22] Filed: Jul. 17, 1997

Related U.S. Application Data

[63] Continuation of Ser. No. 789,409, Jan. 29, 1997, abandoned, which is a continuation of Ser. No. 576,920, Dec. 22, 1995, abandoned, which is a continuation of Ser. No. 483,884, Jun. 7, 1995, abandoned, which is a continuation of Ser. No. 345,868, Nov. 28, 1994, abandoned, which is a continuation of Ser. No. 240,601, May 10, 1994, abandoned, which is a continuation of Ser. No. 897,901, Jun. 12, 1992, abandoned, which is a continuation-in-part of Ser. No. 704,075, May 22, 1991, abandoned.

[51] Int. Cl.[6] ..... B65D 19/44

[52] U.S. Cl. ..... 108/55.1; 108/56.3

[58] Field of Search ..... 108/51.11, 54.1, 108/55.1, 55.3, 56.1, 56.3

[56] References Cited

U.S. PATENT DOCUMENTS 3,355,167 11/1967 Reeves .
3,812,792 5/1974 LaBelle .
3,880,286 4/1975 Wegener .
4,230,050 10/1980 Mays .
4,805,777 2/1989 Mandel .
4,869,179 9/1989 Sammons .
5,067,418 11/1991 Carter .

*Primary Examiner*—Jose V. Chen
*Attorney, Agent, or Firm*—Wood, Phillips, VanSanten, Clark & Mortimer

[57] ABSTRACT

A collapsible pallet has a transverse platform with a number of peripheral openings formed along opposite side edges of the platform. A pair of spaced apart support runners formed from a continuous curved steel rod extend along the underside of the platform, with an upstanding portion of each runner projecting through the openings in the platform. A pair of transverse stiffeners having spaced apart eyes engage the upstanding portions of each runner to rigidify the interconnected platform and runners. The stiffeners are formed from a flat metal strap with opposite ends of the strap being curved to define the eyes.

26 Claims, 4 Drawing Sheets

COLLAPSIBLE PALLET

This is a continuation of Ser. No. 8/789,409, filed Jan. 29, 1997, now abandoned, which is a continuation of Ser. No. 8/576,920, filed Dec. 22, 1995, now abandoned, which is a continuation of Ser. No. 8/483,884, filed Jun. 7, 1995, now abandoned, which is a continuation of Ser. No. 8/345,868 filed Nov. 28, 1994, now abandoned, which is a continuation of Ser. No. 8/240,601, filed May 10, 1994, now abandoned, which is a continuation of Ser. No. 7/897,901 filed Jun. 12, 1992, now abandoned, which is a CIP of Ser. No. 7/704,075 filed May 22, 1991, now abandoned.

FIELD OF THE INVENTION

This invention relates to pallets used in the transport of bulk material and, more particularly, to collapsible or knock down pallets which can be easily assembled and dissembled for storage and shipment.

BACKGROUND OF THE INVENTION

Pallets are used extensively in commerce to transport virtually all types of material in bulk. Loaded pallets are normally handled by forklift trucks having a pair of elongated tines which are positioned along the underside of the pallet. The tines are mechanically powered by the forklift truck to lift the pallet and the bulk payload for transportation to another location.

It is desirable for a pallet to allow the forklift tines to be placed into a proper pallet-engaging position, that is, along the underside of the pallet. It is known to construct a pallet with at least a portion of the pallet being elevated with respect to a supporting surface. The forklift tines are inserted under the elevated portion and the pallet is lifted. See, for example, Steubing U.S. Pat. No. 1,838,589, and Burk U.S Pat. No. 3,130,692. Steubing shows a portable skid with U-shaped legs which are rigidly attached to the skid with bolts. Burk has expendable legs formed from a number of pieces of welded wire. The legs puncture a paperboard pallet and engage the slots of an anvil member fixed to the pallet.

Due to the abundant use of pallets, it is particularly advantageous for a pallet to be inexpensive and easily reused. Frequently a loaded pallet is shipped to a delivery destination, at which point the payload is removed and the pallet is returned to the supplier for subsequent deliveries. To facilitate the return of the pallet, the pallet platform and legs should be easy to dissemble to reduce the storage space required and make the emptied pallet easier to handle.

Steubing requires that the legs be rigidly fixed to the pallet, thereby limiting the ease with which the pallet can be assembled and dissembled. Further, in certain industries, such as, for example, the manufacture of steel, it is not uncommon to load a pallet with several hundred pounds of metal. Consequently, pallets used in such applications must be quite strong and durable. In Burk, the paperboard pallet and expendable legs are incapable of withstanding heavy loads.

SUMMARY OF THE INVENTION

A principal feature of the invention is the provision of a collapsible pallet which can be readily dissembled to facility storage and transportation of the pallet. The collapsible pallet has a horizontal wooden platform with a number of peripheral openings formed along opposite side edges of the platform. A pair of spaced apart support runners formed from a continuous curved steel rod extend along the underside of the platform, with an upstanding portion of each runner projecting through an opening in the platform such that the runners are readily removable for disassembly of the pallet. A pair of transverse stiffeners have spaced apart eyes which receive the opposite upstanding portions of each runner to rigidify the interconnected platform and runners. The stiffeners are formed from a flat metal strap with opposite ends of the strap being curved to define the eyes. Alternatively, the stiffeners are formed from a steel rod having looped ends.

In one form of the invention, the platform is a rectangular wooden panel. Alternatively, the collapsible pallet has a pair of spaced apart slats which define the platform. A pair of support runners are associated one each with the slats and extend along the underside of the platform. A pair of substantially L-shaped recessed channels are formed in each slat in alignment with each other, and a steel rod having spaced apart substantially L-shaped ends is removably received in the recessed channels to stiffen the pallet. A metal strap is positioned between each runner and the underside of the platform to evenly distribute the load to prevent the runners from damaging the underside of the platform.

DETAILED DESCRIPTION OF THE INVENTION

Figure 1:
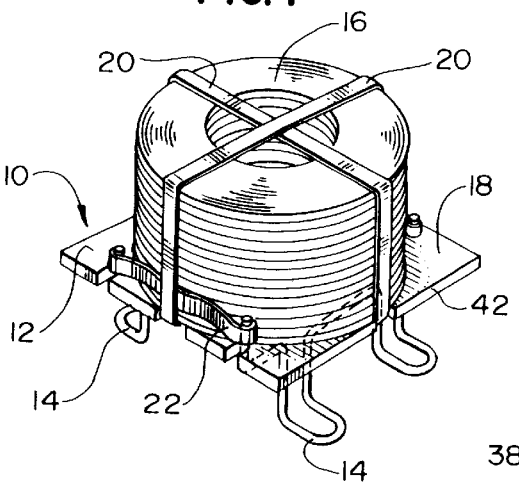
FIG. 1 is a diagrammatic illustration of collapsible pallet supporting a payload.

A collapsible pallet is shown in FIG. 1 generally at 10 and includes a substantially horizontal platform 12 supported on a pair of spaced apart elongated runners 14. A payload 16, such as, for example, coiled steel wire, rests on an upper side 18 of platform 12 and is secured to the pallet by means of ties 20 which wrap around the payload and platform 12. Transverse stiffeners 22 overlie upper side 18 of platform 12 and interconnect the runners 14.

Figure 2:
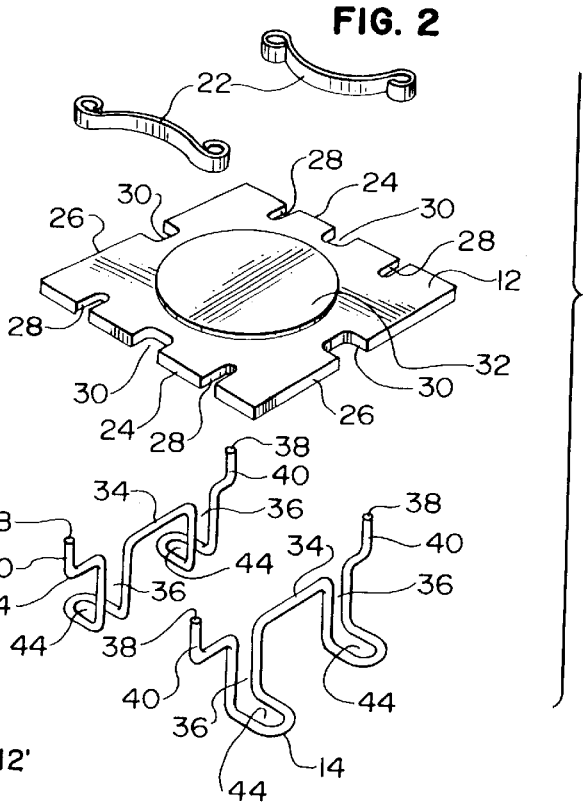
FIG. 2 is an exploded diagrammatic illustration of the collapsible pallet illustrated in FIG. 1.
Figure 2A:
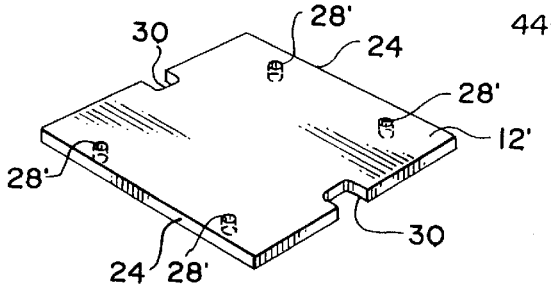
FIG. 2*a* is a diagrammatic illustration of an alternative platform.

Platform 12 is a wooden plate approximately 48 inches square by ⅝ inches thick, having a first pair of opposite side edges 24 and a second pair of opposite side edges 26. Platform 12 can alternatively be formed of metal, in which case a considerably thinner platform can be used without effecting the strength of the pallet. A pair of notched openings 28 extend inwardly from each of the opposite sides 24 and open to upper side 18 of the platform 12. Rectangular notches 30 are formed one in each of platform sides 24 and 26. A cushioning pad 32 is positioned centrally on upper side 18 of the platform, pad 32 being formed of vinyl, rubber, or related compliant materials. An alternative platform 12' is illustrated in FIG. 2*a* and has a pair of openings 28' entirely inwardly of each of the opposite sides 24 and open to upper side 18 of the platform 12.

Each of the elongated runners 14 are formed of a continuous curved steel rod and define a platform support 34 formed between a pair of depending legs 36. The steel rod has generally circular cross section having a diameter of approximately ½ inch. Each runner terminates at opposite ends 38 in an upstanding portion 40. The runners extend along an underside 42 of platform 12 with the upstanding end portions 40 projecting through a corresponding notch 28. Runner ends 38 extend above the upper side 18 of the platform 12 and the platform is supported on the platform support 34. Each depending leg 36 has a substantially horizontally extending foot 44 for stably supporting the payload 16 carried by the platform 12.

Transverse stiffener 22 is an elongated steel bar having opposite ends 46 and spaced apart side edges 48 and 50. Each end 46 of the bar 45 is curved to define a substantially closed loop 52. The bar 45 is also curved along a center bar portion 54 between the opposite ends 46. Preferably, a transverse stiffener 22 extends along each side of the platform 12 in substantially parallel relation with opposite sides 24. The closed loops 52 define eyes which removably engage a respective upstanding end portion 40 of each runner 14 extending through the platform 12. The transverse stiffeners 22 rest on platform 12 along side edge 48 in an upright orientation, with the curvature of portion 54 of each stiffener stabilizing the stiffener on the platform and efficiently distributing reaction forces.

In addition to the specific construction detailed above with respect to transverse stiffener 22, the present invention also envisions an alternative stiffener design. Particularly, a transverse stiffener 56 is formed from a continuous steel rod and has spaced apart loops 58 formed at opposite ends of the rod for engaging upstanding end portions 40 of the runners. Alternatively, a transverse stiffener 60 is an elongated flat steel bar having a generally circular opening 62 formed at opposite ends 64 of the bar. Stiffener 60 lies flat on the platform 12 with the runner end portions 40 engaging the openings 62.

Assembly of collapsible pallet 10 can be summarized as follows. Runners 14 are placed in a generally parallel spaced apart relationship on the surface over which payload 16 is to be supported. Horizontally extending feet 44 formed on each runner allow the runners to be self standing. Once runners 14 are properly aligned, platform 12 is lowered over the runner ends 38 with the upstanding runner portions 40 projecting through notches 28 in the platform. Stiffeners 22 are then installed, with the spaced apart eyes 52 engaging the ends of each runner to stabilize the pallet. Payload 16 is then placed on the platform 12 with pad 32 sandwiched therebetween to prevent damage to the underside of the payload. Runner ends 38 abut the sides of the payload 16 and help to prevent the payload from shifting on the pallet. Ties 20 are then wrapped around the payload and received in notches 30 on each side of the platform to prevent the ties from shifting.

Figure 6:
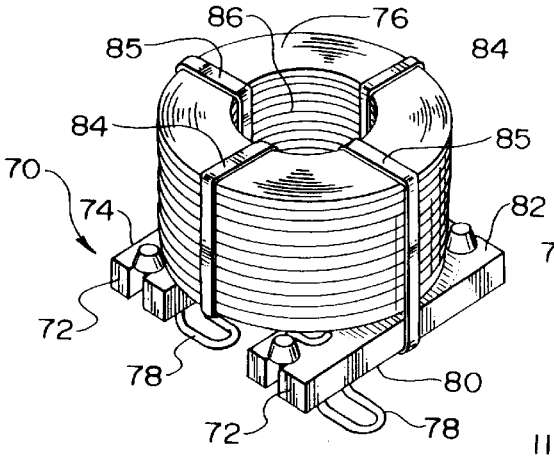
FIG. 6 is a diagrammatic illustration of an alternative collapsible pallet supporting a payload.

An alternative collapsible pallet is illustrated in FIG. 6 generally at 70 and has a pair of elongated spaced apart slats 72 defining a substantially horizontal platform 74 for supporting a coiled payload 76. A pair of elongated runners 78 are associated one each with the slats 72 and extend along an underside 80 of the platform. Coiled payload 76 is secured to an upper side 82 of platform 74 by a number of ties 84 and 85 which wrap around the coil and through a central eye 86, with ties 85 extending around the underside 80 of slats 72 to secure the payload. When a number of pallets are stored in a side by side arrangement, with the slats 72 of each adjacent platform in abutting relation, ties 85 can extend through the eyes 86 of each of a pair of adjacent coiled payloads 76 and around the underlying abutting slats 72 to secure a pair of adjacent pallets.

Figure 7:
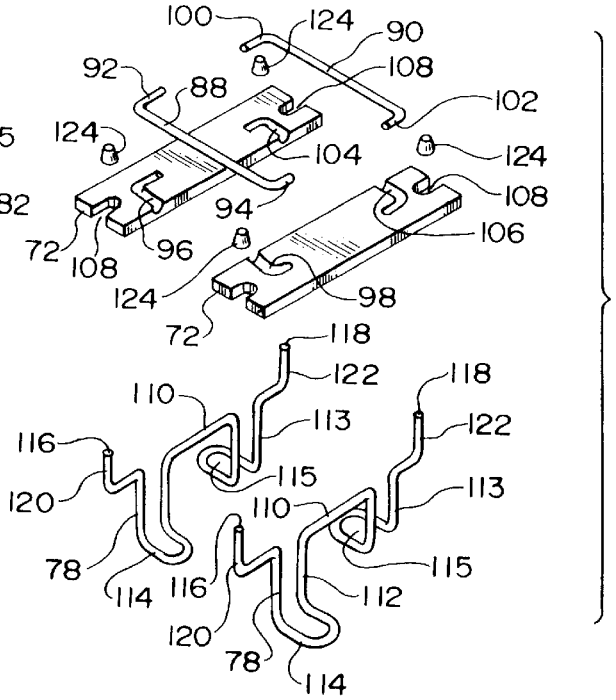
FIG. 7 is an exploded diagrammatic illustration of the collapsible pallet illustrated FIG. 6.
Figure 7A:
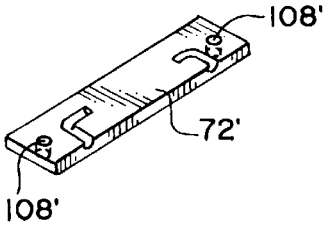
FIG. 7*a* is a diagrammatic illustration of an alternative slat.

Each slat 72 is a wooden plank having a rectangular cross-section with a dimension of approximately 2 inches by 4 inches. As discussed above with respect to the platform 12, the slats 62 can alternatively be formed of metal, in which case a considerably thinner slat can be used without effecting the strength of the pallet. In addition, because the slats 72 are supported by an associated runner 78 over the length of the slat and are not subjected to high bending loads, the slats 72 can be formed of a light weight material which offers sufficient compressive strength to withstand the weight of the payload 16. Exemplary materials which would be suitable for use as a slat 72 include composite material, laminated paper, and recycled plastic. Plastic is particularly useful in food service applications of a pallet due to the ease with which plastic materials can be brought into compliance with sanitary codes. An inwardly opening notch 108 is formed at each end of each the slats. Alternatively, and as illustrated in FIG. 7*a,* an opening 108' is formed entirely inwardly of each end of a slat 72'.

A pair of transverse spacers 88 and 90 interconnect the spaced apart slats and rigidify the pallet 70. Spacer 88 is a continuous steel rod having substantially L-shaped opposite ends 92 and 94 which are removably received in complementary recessed channels 96 and 98, respectively, formed in alignment in the upper side of slat 72. Transverse spacer 90 is a continuous steel rod having substantially L-shaped opposite ends 100 and 102 which are removably received in complementary recessed channels 104 and 106, respectively, formed in the upper side of the slats 72.

Figure 7B:
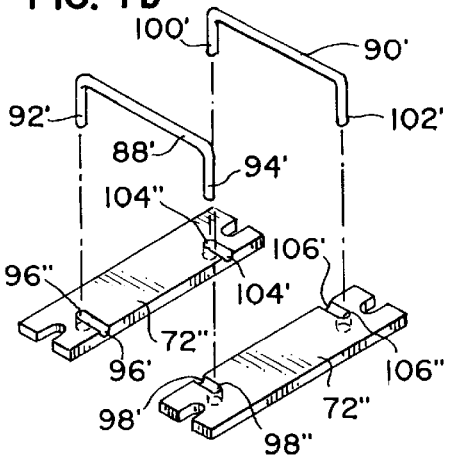
FIG. 7*b* is a fragmentary diagrammatic illustration of an alternative transverse stiffener for the collapsible pallet illustrated in FIG. 6.

In the alternative form illustrated in FIG. 7*b,* slats 72" have corresponding recessed channels 96', 98' and 104', 106'. The channels 96', 98', 104' and 106' are straight channels and have vertical openings 96", 98", 104" and 106", respectively, which extend downwardly through a corresponding slat 72". A steel rod 88' has substantially vertical ends 92' and 94' which are received in the openings 96" and 98", respectively. A steel rod 90' has ends 100' and 102' which are received in the openings 104" and 106", respectively.

Runners 78 are formed from a continuous curved steel rod having a diameter of approximately ½ inch and define a slat support 110 between a pair of depending legs 112 and 113. Legs 112 have a substantially horizontally extending foot 114 and legs 113 have a substantially horizontally extending foot 115. Feet 114 extend in a direction opposite to feet 115 to improve the stability of the pallet.

Each runner 78 has opposite ends 116 and 118 and extends between an upstanding portion 120 and 122, respectively, formed at each end. The slats 72 are supported on the slat support 110 of an associated runner 78, with upstanding runner end portions 120 and 122 projecting through the notches 108 in slats 72. Lock washers 124 are secured to the ends 116 and 118 of the runners to firmly secure the underlying slats 72.

Figure 8:
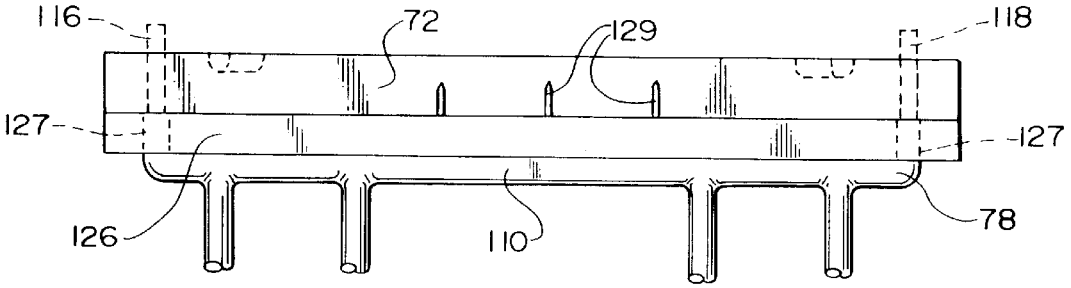
FIG. 8 is a fragmentary side elevational view of the collapsible pallet illustrated FIG. 6 having a metal reinforcement strap positioned between the platform and an underlying runner.
Figure 9:
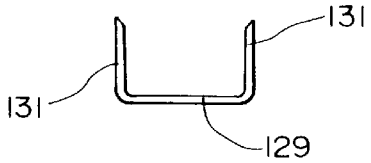
FIG. 9 is a diagrammatic illustration of a staple used to reinforce the collapsible pallet illustrated in FIG. 6.

When payloads of excessive mass are supported on the pallet, it is desirable to provide a means for effectively distributing the load over the pallet and reducing the contact forces between the wooden platform and the underlying metal runners. Accordingly, rectangular metal reinforcing straps 126 (one shown in FIG. 8) are placed along the underside of each slat 72 and supported on slat support 110 of underlying runner 78. Straps 126 have circular openings 127 formed in the opposite strap ends for receiving the upright runner ends 120 and 122. To restrict longitudinal cracking of the wooden slats 72, a number of generally U-shaped metal staples 129 are driven into the underside of the slats and spaced along the length of the slats. Opposite legs 131 formed on the staples 129 project upwardly into the slats 72 to oppose lateral separation of the wood.

Figure 10:
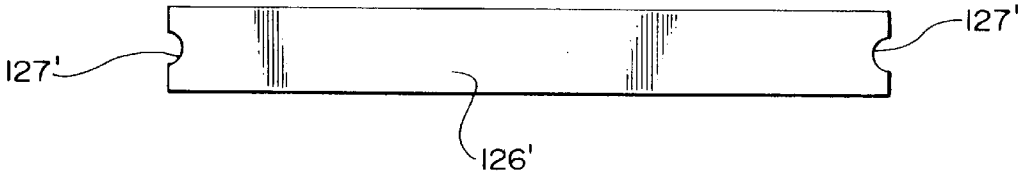
FIG. 10 is a top plan view of an alternative reinforcement strap.

Alternatively, and as shown in FIG. 10, reinforcement straps 126' could be used. Straps 126' have semi-cylindrical grooves 127' formed in the opposite strap ends for engaging the inner surfaces of the upright runner ends 120 and 122 and can be formed easily from a continuous strip of material. When the reinforcement straps 126 or 126' are used, smaller slats 72 can be used without reducing the overall strength of the pallet. For instance, wooden slats having a cross-sectional dimension of approximately 1 inch by 4 inches can be substituted when the reinforcing plates are used.

Figure 3:
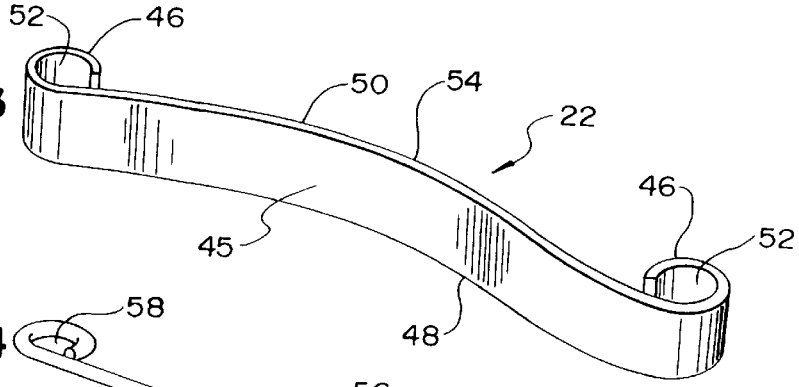
FIG. 3 is a diagrammatic illustration of a transverse stiffener illustrated in FIGS. 1 and 2.
Figure 4:
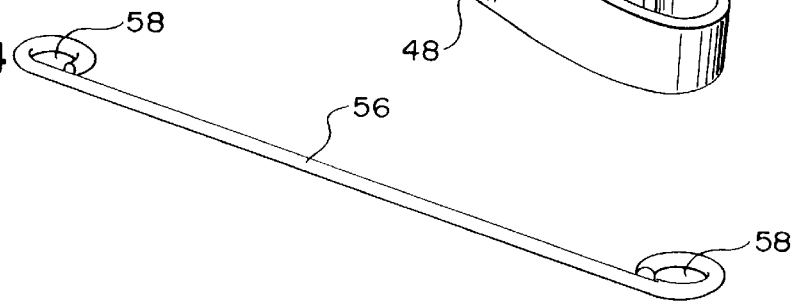
FIG. 4 is a diagrammatic illustration of an alternative transverse stiffener.
Figure 5:
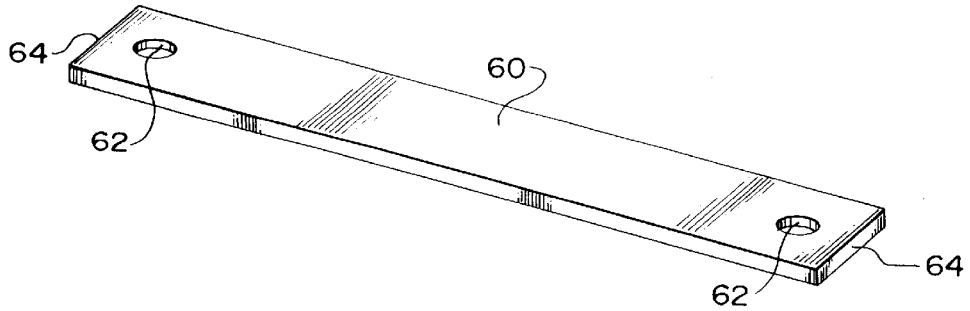
FIG. 5 is a diagrammatic illustration of a second alternative transverse stiffener.
Figure 11:
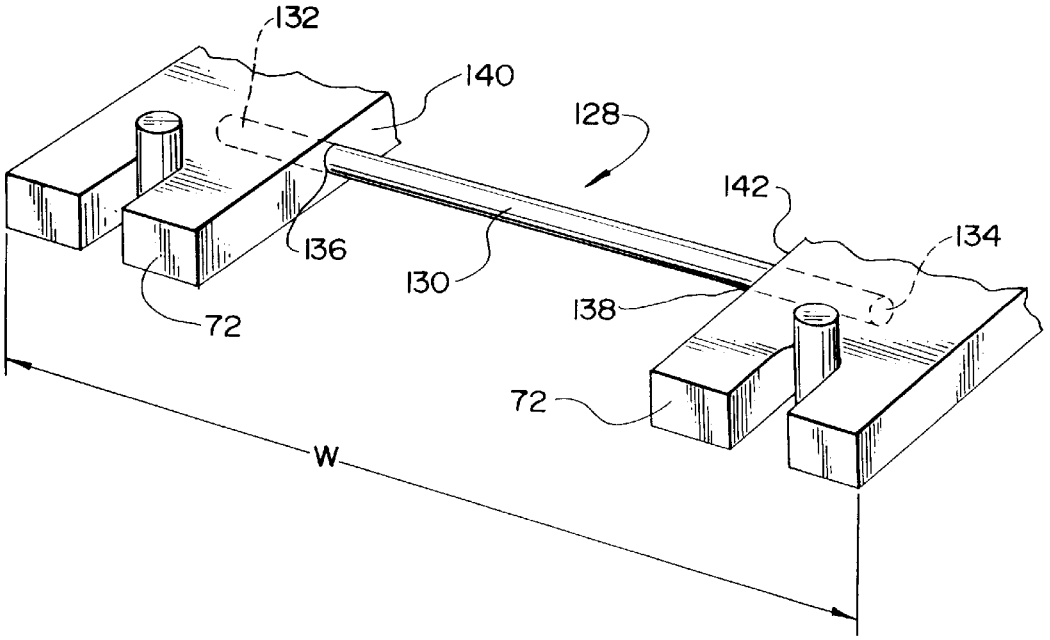
FIG. 11 is a fragmentary diagrammatic illustration of an alternative transverse stiffener.

An alternative transverse stiffener 128 is illustrated in FIG. 11. It should be understood, however, that transverse stiffener 128 may be utilized in conjunction with transverse stiffeners 88 and 90 above. Further, any of the stiffeners illustrated in FIGS. 3 through 5 are readily adapted for use with the collapsible pallet 70.

Transverse stiffener 128 is an elongated steel rod 130 having opposite ends 132 and 134 which are tightly fitted in holes 136 and 138, respectively, drilled in inwardly directed side faces 140 and 142, respectively, of the spaced apart slats 72. Holes 136 and 138 are drilled such that rod sends 132 and 134 are tightly fitted within the slats, with the length of rod 130 and the depth of the holes 136 and 138 prescribing a width W of the pallet. By varying the length of the stiffener and the depth of the holes, it is possible to expand the pallet to accommodate payloads of varying size.

Figure 12:
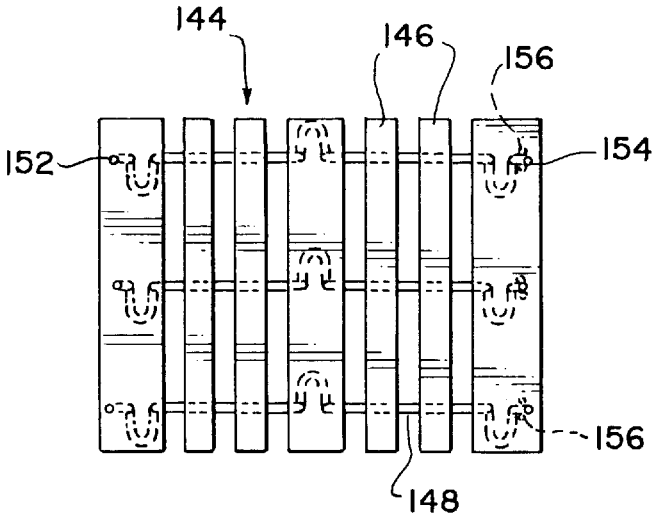
FIG. 12 is a top view of a second alternative pallet.
Figure 13:
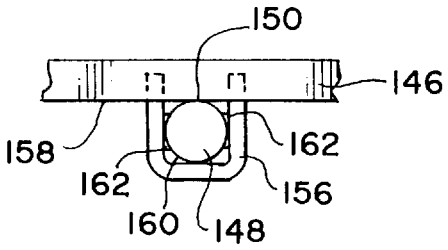
FIG. 13 is fragmentary diagrammatic illustration of staple engaged with a slat and welded to a runner

A second alternative embodiment of a collapsible pallet is illustrated in FIG. 12 generally at 144 and has a plurality of parallel slats 146 supported on and extending transversely between a plurality of runners 148. Each runner 148 has a surface 150 extending laterally between spaced apart runner ends 152 and 154 for supporting the slats 146. The runner ends 152 and 154 project upwardly through openings formed in the endmost slat 146.

Figure 14:
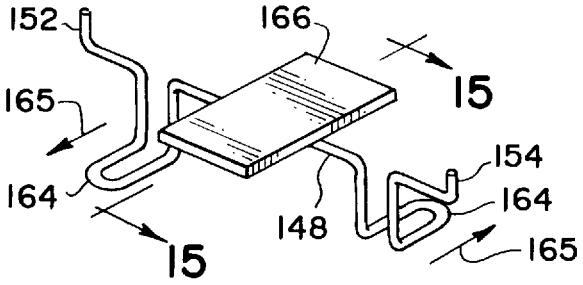
FIG. 14 is a diagrammatic illustration of a steel tab welded to a runner.
Figure 15:
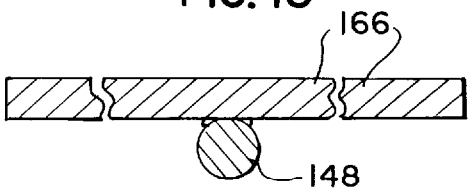
FIG. 15 is an enlarged section taken along line 14—14 of FIG. 14.

One or more generally U-shaped metal staples 156 are partially inserted in the underside 158 of the slats 146 and define a opening 160 for receiving a runner 148. Each staple 156 is welded to an associated runner 148 at a pair of diametrically spaced locations 162. As shown in FIG. 14, downward vertical force on a runner 148 causes the runner to twist and the feet 164 tend to "walk" oppositely in the direction of the arrows 165. The rigid connection between the slat 146, the staple 156 and the runner 148 transmit torsional forces to the slat 146 and reduce torsional deformation of the runner 148 when a payload 16 is placed on the slats 146.

As an alternative to using a staple, a flat steel tab 166 (FIG. 14) is welded to the support surface 150 of a runner and engages the underside of a slat 166. In a preferred form, the tab 166 has 1" by 3" surface for engaging an overlying slat 166 and is approximately ⅓" thick.

I claim:

1. A collapsible pallet comprising:

a transverse platform for supporting a load and having edges, an underside and an upper side with openings formed in the platform; and a pair of separable runners extending along the underside of the platform and having depending legs for supporting the platform on a base, each runner terminating at opposite end portions which are removably received in the openings in the platform and readily detachable therefrom to facilitate disassembly of the pallet.

2. The collapsible pallet of claim 1 in which the openings extend inwardly from the opposite side edges of the platform.

3. The collapsible pallet of claim 1 in which the openings are entirely inward of the side edges of the platform.

4. The collapsible pallet of claim 1 including a transverse stiffener interconnecting the runners to rigidify the pallet and the runner.

5. The collapsible pallet of claim 4 in which the transverse stiffener comprises an elongate strap having spaced apart ends with an eye formed at each strap end, each eye engaging a respective upstanding end portion of each runner.

6. The collapsible pallet of claim 5 in which the transverse stiffener comprises an elongate steel bar having opposite ends and spaced apart side edges, each end of the bar being curved to define a substantially closed loop for receiving a respective upstanding end portion of each runner with the bar being supported along one of the stiffener side edges in an upright orientation on the platform.

7. The collapsible pallet of claim 6 in which the steel bar is curved between the opposed closed loops.

8. The collapsible pallet of claim 5 in which the stiffener comprises a flat steel bar having spaced apart ends, the eye at each bar end being formed by an opening which engages a respective end portion of each runner.

9. The collapsible pallet of claim 5 in which the stiffener comprises a steel rod having spaced apart looped end portions.

10. The collapsible pallet of claim 1 in which the depending legs on each runner have a substantially horizontally extending foot.

11. The collapsible pallet of claim 1 in which the load is secured to the pallet by means of a tie which wraps around the load and the platform, the platform having notches along the opposite side edges for positioning the tie.

12. The collapsible pallet of claim 1 in which the platform is made from a material selected from the group consisting of wood, metal, plastic, paper and composite material.

13. The collapsible pallet of claim 1 in which the platform is made of metal, the collapsible pallet including a cushion positioned between the load and the upper side of the platform.

14. The collapsible pallet of claim 1 in which the platform is a rectangular panel.

15. The collapsible pallet of claim 1 in which the platform comprises a pair of elongate slats separated by a transverse spacer, each slat being supported by an associated underlying runner.

16. The collapsible pallet of claim 15 in which a recessed channel is formed in each slat open to the upper side of the platform, the transverse spacer comprising a steel rod having opposite ends which are formed in complementary relation to the recessed channel and removably received therein to facilitate the disassembly of the pallet.

17. The collapsible pallet of claim 16 in which a pair of substantially L-shaped recessed channels are formed one in each slat in alignment with each other, the steel rod having spaced apart substantially L-shaped ends removably received in the recessed channels to interconnect the elongate slats.

18. The collapsible pallet of claim 16 in each the transverse spacer comprises a straight steel rod having spaced apart ends, each slat having a side edge with a laterally opening hole of a selected depth for removably receiving one end of the rod.

19. The collapsible pallet of claim 15 including fasteners which engage upstanding runner end portions above the platform to secure the slats against the associated runners.

20. The collapsible pallet of claim 15 in which a flat steel strap is interposed between each slat and the associated runner to reinforce the platform when a payload is supported by the pallet.

21. The collapsible pallet of claim 15 in which the elongate slats are formed of wood, the collapsible pallet having a number of metal staples with spaced legs engaging the wooden slats to oppose separation of the wood contained therein.

22. The collapsible pallet of claim 1 in which each runner has a laterally extending surface between each of the pair of depending legs and in which the platform comprises a plurality of elongate slats supported on and extending transversely between the lateral surface on the runners.

23. The collapsible pallet of claim 22 in which a flat tab is rigidly attached to the laterally extending surface of a runner and engaged with the underside of the platform to resist torsional deformation of the runner when a mass is supported on the platform.

24. The collapsible pallet of claim 23 in which the flat tab and the runner are made of metal and the tab is welded to the runner.

25. The collapsible pallet of claim 22 in which a staple is inserted in a slat and defines an opening on the underside of the platform for receiving a runner, the staple being rigidly attached to the runner to resist torsional deformation of the runner when a mass is supported on the platform.

26. The collapsible pallet of claim 25 in which the staple and the runner are made of metal and the staple is welded to the runner.

* * * * *